US005254908A

United States Patent [19]

Alt et al.

[11] Patent Number: 5,254,908

[45] Date of Patent: Oct. 19, 1993

[54] SIGN BOARD LIGHTING CONTROL SYSTEM

[75] Inventors: Larry G. Alt, Crown Point; Robert C. Florin, Hammond; Joseph H. Little, Valparaiso; Richard C. Oesterle, Crown Point, all of Ind.

[73] Assignee: Profile Systems, Merrillville, Ind.

[21] Appl. No.: 865,108

[22] Filed: Apr. 8, 1992

[51] Int. Cl.[5] ..... H05B 41/00

[52] U.S. Cl. ..... 315/312; 340/825.49

[58] Field of Search ..... 315/153, 210, 312, 313, 315/314, 315; 340/906, 825.36, 825.49

[56] References Cited

U.S. PATENT DOCUMENTS

| | | | |
|---|---|---|---|
| 1,814,346 | 7/1931 | Stevenson | 361/182 |
| 2,462,343 | 2/1949 | Wohlgemuth | 340/825.16 |
| 3,732,558 | 5/1973 | Justice | 340/330 |
| 4,242,614 | 12/1980 | Vatis et al. | 315/153 |
| 4,355,309 | 10/1982 | Hughey et al. | 340/825.53 |
| 4,454,509 | 6/1984 | Buennagel et al. | 340/825.69 |
| 4,716,301 | 12/1987 | Willmott et al. | 307/115 |
| 4,857,921 | 8/1989 | McBride et al. | 340/906 X |
| 4,962,522 | 10/1990 | Marian | 379/5 |
| 5,061,921 | 10/1991 | Lesko et al. | 340/815.24 |
| 5,089,814 | 2/1992 | Deluca et al. | 340/825.49 |

*Primary Examiner*—Steven Mottola

*Attorney, Agent, or Firm*—Lockwood, Alex, Fitzgibbon & Cummings

[57] ABSTRACT

A sign board lighting control system for remotely controlling the lighting of a plurality of sign boards includes a radio transmitting device at a central location, and a radio receiving device and a lighting control unit at each sign board location. During set-up of a sign board, programming signals designating the mode of operation and the location of the sign board are transmitted by radio to the control unit associated with each sign board. Subsequently, timing signals containing a multiple-digit computer generated code designating the time of day and the time of sunrise and sunset on a particular day within particular latitudinal zones are transmitted by radio to the control units of all sign boards. Each lighting control unit interprets and responds to the timing signals in accordance with previously received programming signals to control the illumination of the sign board in accordance with a predetermined lighting protocol.

71 Claims, 6 Drawing Sheets

SIGN BOARD LIGHTING CONTROL SYSTEM

BACKGROUND OF THE INVENTION

The present invention relates to sign board lighting control systems, and more particularly to a system whereby programming and reference instructions are conveyed to remote, individual sign board lighting control units by means of radio transmissions such that the lighting systems associated with such units operate in accordance with predetermined lighting protocols or modes.

Sign board lighting systems have come into wide use for illuminating outdoor billboards and the like during the time period between sunset and sunrise. Sign boards which require such illumination exist in very diverse locations, such as along highways or on buildings, and often in very remote places. Moreover, sign boards owned and maintained by a major outdoor advertising company can be located hundreds, or even thousands, of miles apart.

Because it is neither necessary nor desirable to continuously illuminate sign boards, sign board lighting systems are operated only during certain, discreet time periods, or lighting protocols. Typically, such lighting protocols are established by contract between an advertiser and the sign board owner, and may, for example, be from sunset to sunrise or from sunset, until a certain specified time at night. By accurately conforming the time period during which the sign board lighting system is activated to the protocol required by the contract, significant savings are realized from decreased electrical power consumption and extended lamp life.

Prior systems for controlling sign board lighting typically utilized photocells, timers or a combination thereof, to regulate the lighting circuitry. Because of inherent deficiencies in these designs, the operation of such sign board lighting control systems was often less than optimum.

For example, since the time of sunset at a particular sign board location varies on a daily basis and therefore cannot be readily established with a conventional timer, photocells were often utilized to activate a sign board lighting system at sunset. However, such photocells proved to be a crude means of determining the time of sunset, because variations in atmospheric conditions caused the light intensity measured by the photocells at the time of actual sunset to fluctuate dramatically. Thus, on cloudy days such systems would sometimes illuminate the sign board long before sunset. This was an even greater problem in areas where the photocell lens became dirty or otherwise obstructed with time.

Often it is required to alter the lighting protocol of a particular signboard, i.e., to change the times each day when the lighting system is to be activated or deactivated. For example, it is common for a contract between advertiser and sign board owner to require that the sign board lighting system be deactivated at a particular local time each day. In such a case, upon a time change from "standard time" to "daylight savings time," or vice-versa, the mode of operation of the sign board lighting system must be altered to account for the hour time change. Or, for example, the advertiser contracting for the sign board may decide that the sign should remain illuminated to a later time, say midnight instead of 10:00 p.m. Or, upon the expiration of the advertising contract, the owner of the sign board may wish to completely discontinue illuminating the sign board until a new advertiser is secured.

In order to alter the lighting protocol of prior sign board illumination systems it was necessary for a repair crew to visit the sign board site. Because of the diverse, remote and often virtually inaccessible location of many sign boards, this was often an arduous, time-consuming and expensive task.

Certain prior sign board lighting control systems utilized radio transmissions to actuate the systems. The sign boards were categorized into groups of one or more sign boards and turned on or off as a group in response to radio signals. Where a large number of geographically separated sign boards exist, such systems are not practical because of the high cost and time required to send individual radio signals to each sign board or group of sign boards. Moreover, as with sign boards controlled by photocells and timers, such prior sign board lighting control systems did not provide the capability to remotely program the lighting protocol of individual sign boards.

It has been proposed that a control system be developed whereby individual sign boards may be controlled by radio signals. However, such a system would prove unduly expensive because major sign board companies own thousands of sign boards. Since each sign board would require its own transmissions, an excessive number of transmissions would be necessary to effectively control the system.

The present invention overcomes these drawbacks by providing a system whereby both programming and timing signals are communicated to a sign board lighting control system. In particular, the invention provides for transmissions of coded programming signals which designate a particular lighting protocol to a particular sign board. Additionally, the invention provides for timing signals necessary for performing the various different lighting protocols of multiple sign board lighting control units to be accomplished by a limited number of universal reference transmissions received by all sign boards.

A control unit associated with an individual sign board lighting system includes a receiver capable of intercepting the radio-transmitted coded programming and timing signals and control circuitry capable of decoding such signals and either storing in memory programming signals or executing functions in response to timing reference signals, as the case may be.

Accordingly, it is a general object of the present invention to provide a new and improved control system for sign board lighting systems or the like.

It is a more specific object of the present invention to provide a new and improved control system for sign board lighting systems wherein the system comprises a computer controlled radio frequency transmitter for transmitting coded programming and timing reference signals to a radio frequency receiver associated with individual sign boards, which signals are utilized by a control unit which actuates or deactivates the sign board lighting system in response to the coded signals. This remote programming capability eliminates the need for "on-site" programming.

It is an additional object of the present invention to provide a new and improved sign board lighting control system whereby commercially available "paging" or "beeper" systems transmit coded programming or timing reference signals to control units associated with individual sign board lighting systems. The control units decode the signals and activate or deactivate the sign board lighting system in accordance with the programming and timing reference signals.

SUMMARY OF THE INVENTION

The invention is directed to a system for controlling the illumination of a plurality of sign boards in accordance with a predetermined lighting protocol requiring predetermined on and off times comprising a transmission means for transmitting a reference signal, a lighting control unit associated with each of the sign boards, each control unit including a receiver means for receiving said transmitted reference signal, a timing means responsive to said received reference signal for initiating a timing period and a sign lighting control circuit means responsive to said timing means for controlling the application of operating current to the lighting system of the sign board following said timing period whereby said sign board is caused to be illuminated in accordance with its respective lighting protocol.

The invention is further directed to a lighting control device operable from a received reference signal for controlling the illumination of a sign board in accordance with a predetermined lighting protocol requiring predetermined on and off times comprising a radio receiver means for receiving the reference signal, timing means responsive to the received reference signal for initiating a predetermined timing period and a sign lighting control circuit means responsive to the timing means for controlling the application of operating current to the lighting means of the sign board following the timing period whereby the sign board is caused to be illuminated in accordance with its lighting protocol.

The invention is further directed to a method for controlling the illumination of a selected one of a plurality of sign boards in accordance with a predetermined lighting protocol requiring predetermined on and off times comprising transmitting a reference signal to all of the plurality of sign boards, receiving the transmitted reference signal at the selected sign, initiating a timing period at the selected sign board in response to the received reference signal and controlling the application of operating current to the lighting means of the sign board following the timing period whereby the selected sign board is caused to be illuminated in accordance with the predetermined lighting protocol.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
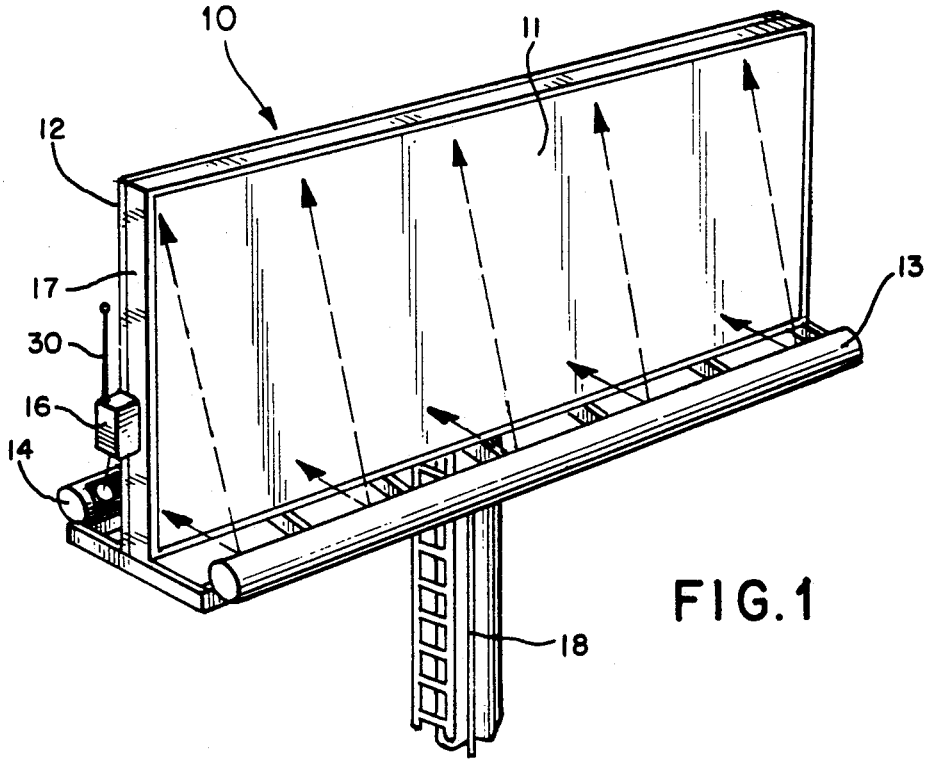
FIG. 1 is a perspective view of a two-sided sign board showing a control unit constructed in accordance with the invention for controlling lighting systems positioned to illuminate respective sides of the sign board.

Referring to the figures and particularly to FIG. 1, a two face sign board 10 has a first face 11 and an oppositely facing second face 12. The two faces are individually illuminated by first and second lighting systems 13 and 14 operated from a conventional AC power source. The operation of lighting systems 13 and 14 is controlled by a sign board control unit 16 mounted on a side panel 17 of sign board 10. A conventional mast 18 supports the sign board in a desired viewing position.

Control unit 16, in response to received programming and reference signals, causes each face of sign board 10 to independently operate in one of five lighting protocols:

1. A "10:00 p.m. off" protocol wherein the face is lighted daily from local sunset to 10:00 p.m., local time.
2. A "12:00 a.m. off" protocol wherein the face is lighted daily from local sunset to 12:00 a.m., local time.
3. A "2:00 a.m. off" protocol wherein the face is lighted daily from local sunset to 2:00 a.m., local time.
4. A "5:00 a.m. on" protocol wherein, in addition to one of the above three protocols, the face is lighted daily from 5:00 a.m. to local sunrise.
5. A "sunrise off" protocol wherein the face is lighted daily from local sunset to local sunrise.

In addition to the above protocols, control unit 16 functions in the following operating modes:

1. "Lock"—wherein the face is not lit, regardless of the programmed lighting protocol.
2. "Unlock"—wherein the "lock" mode is reset and the sign is lighted in accordance with a programmed lighting protocol.
3. "Reset 5:00 a.m."—wherein the "5:00 a.m. on" mode is discontinued and the sign is lit in accordance with a programmed lighting protocol.
4. "Reset service lights"—wherein sign board lights, previously activated locally by a maintenance crew, are remotely reset to an off state.

Control unit 16 may be conditioned to operate in one or more of these modes or lighting protocols. Thus, for example, the 10:00 p.m. off and 5:00 a.m. on modes may together operate to activate one or both lighting systems 13, 14 at sunset and deactivate the systems 13, 14 at 10:00 p.m., after which the 5:00 a.m. on mode activates the lighting systems 13, 14 at 5:00 a.m. and deactivates systems 13, 14 at sunrise. Although the invention provides five exemplary lighting protocols, it will be appreciated that a greater or lesser number of different lighting protocols can be provided. For example, additional 11:00 p.m. off and 6:00 a.m. on protocols, or any other times, could obviously be utilized in accordance with this invention.

In response to the "sunrise off" protocol, control unit 16 actuates the lighting systems at local sunset and deactivates the lighting systems at local sunrise. Unlike the "5:00 a.m. on" protocol, the "sunrise off" protocol does not operate in conjunction with other protocols, and thus overrides any other protocol that provides that control unit 16 will deactivate the lighting systems 13, 14 at any other time.

In the five lighting protocols, the first face 11 and the second face 12 of sign board 10 can be programmed to operate independently in different modes. Although the faces of sign board 10 can be separately programmed, to avoid unnecessary complication the two faces will be henceforth treated as being identically programmed.

In "reset service lights" mode, control unit resets the service lights associated with sign board 10. This mode of operation is used primarily for testing purposes. If an "on site" repair of any kind is necessary for any reason, the service lights are manually activated by the repair crew at the sign board site. Once finished with whatever work is required, a remote transmission encoding the "reset service lights" mode is transmitted to turn off the service lights. The crew at the site can then verify that the radio programming system is operational by observing that the service lights are deactivated.

The present invention relies on certain programming signals, directed to each individual control unit 16, as required, to establish the lighting protocol and required operating parameters for each board; and certain reference signals, sent daily at certain reference times and reference events, such as sunset at a reference location, to cause the control units 16 associated with a large number of sign boards 10 at diverse and widely divergent locations to operate in accordance with individual protocols assigned to each sign.

Figure 2:
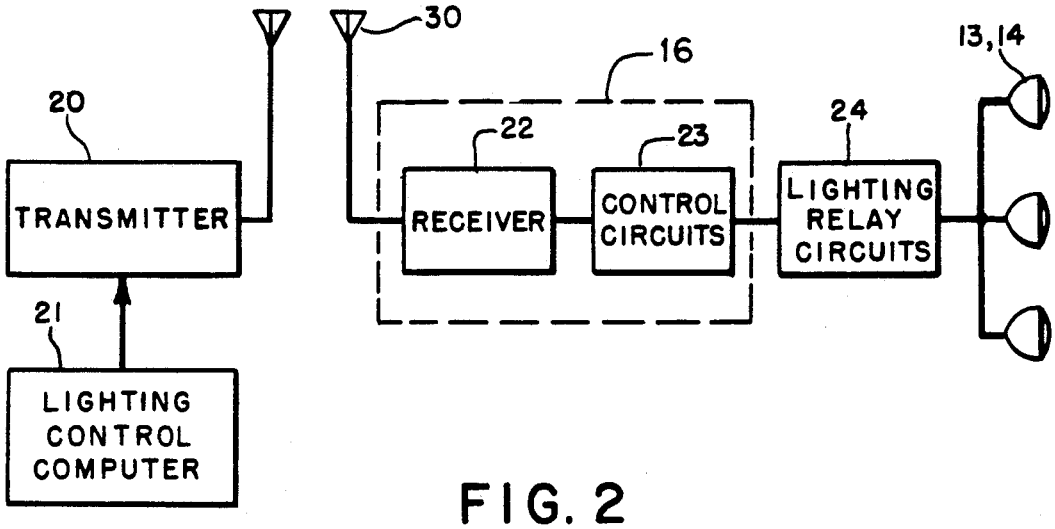
FIG. 2 is a simplified functional block diagram of the sign board lighting control system.

Referring to FIG. 2, required programming and timing reference signals are conveyed to control unit 16 by a radio transmitter 20 operating under the control of a lighting control computer 21 at a central control center, and a radio receiver 22 within the sign board control unit 16. The transmitter 20 and receiver 22 preferably operate on a single predetermined frequency, and may, preferably, comprise part of a satellite personal paging system. As such, the radio receiver 22 may be a commercially available paging or "beeper" receiver and may, with the exception of its data output circuitry, be conventional in design and construction. Typically, such paging or "beeper" receivers operate by monitoring broadcasts on their assigned frequency for an individually assigned cap code. This cap code signals the particular receiver that the transmitter information bearing the cap code is intended for its reception.

Within control unit 16, receiver 22 is connected to control circuits 23, which utilize received information in conjunction with an internal timing reference to a lighting relay circuit 24, which controls the application of power to the lighting systems 13 and 14 of sign board 10.

Figure 3:
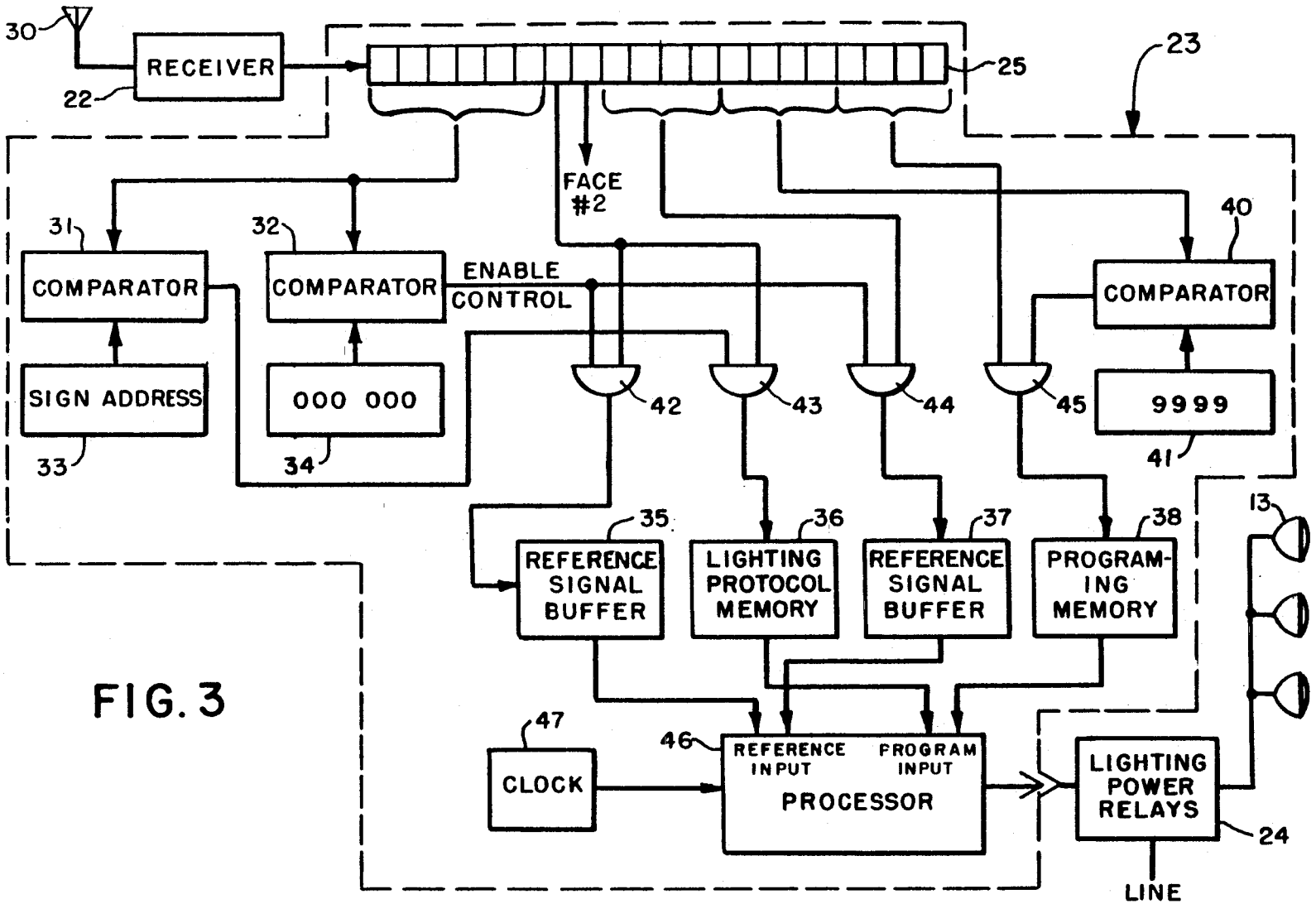
FIG. 3 is a simplified functional block diagram of the control unit shown in FIG. 1.
Figure 4:
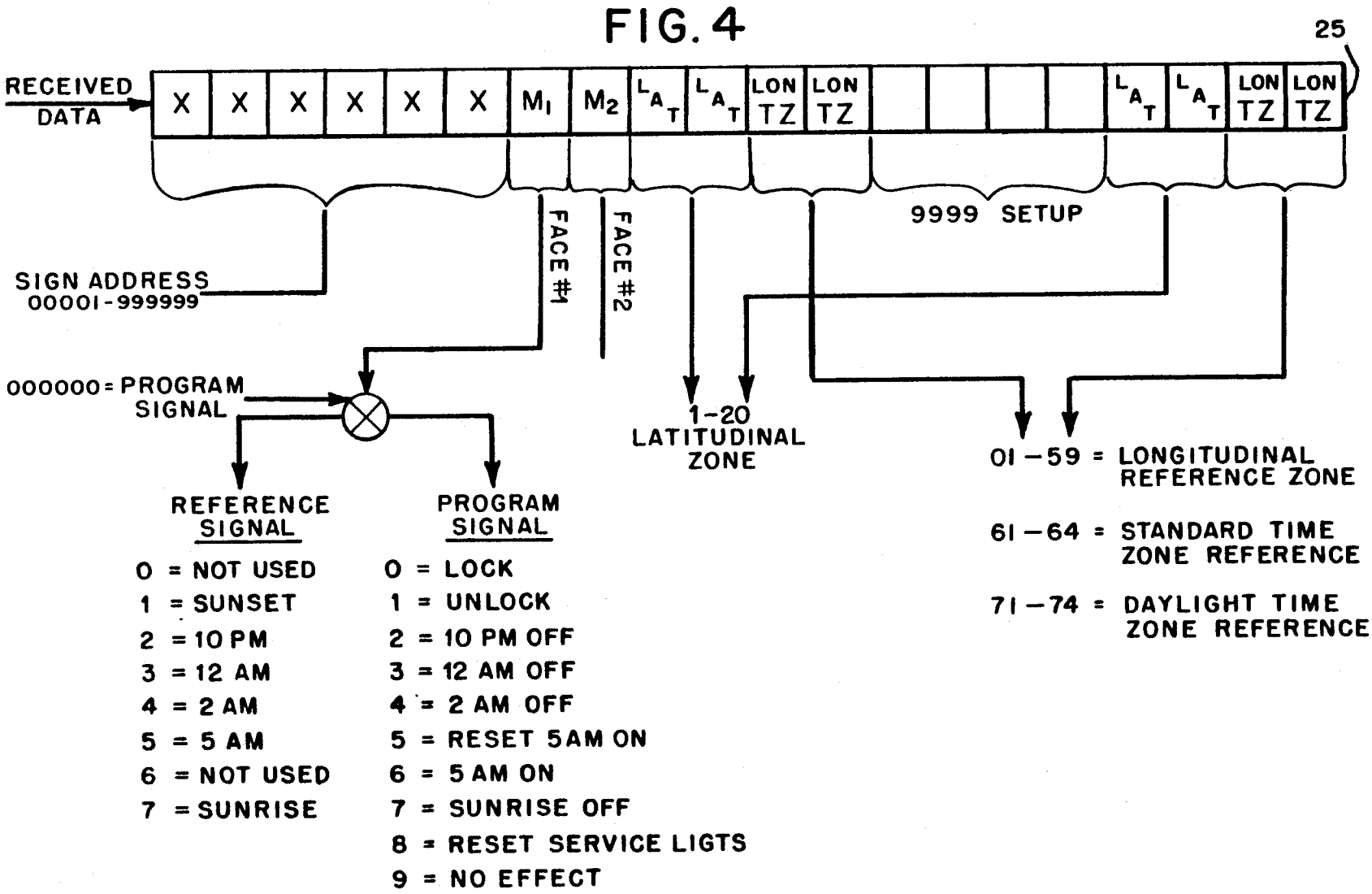
FIG. 4 is a diagram depicting the function of each digit in an exemplary twenty-digit code segment utilized in the lighting control system of FIG. 2.

The illustrated embodiment of the invention utilizes the conventional paging or "beeper" receiver to receive broadcasts of coded reference and programming signals, each represented by a twenty-digit number in a register 25 as shown in FIGS. 3 and 4. The reference signal is transmitted in response to computer 21 which signals transmitter 20 to transmit signals at predetermined times.

The transmission means typically relay their transmissions via satellites in order to effectively transmit throughout the United States, although the invention can also successfully utilize local paging services. Although the invention utilizes a conventional commercially available paging or "beeper" transmission 20 and receiving means 22, it will be appreciated that any other type of radio transmission means, including, for example, cellular telephone communications systems, may also be successfully utilized.

Figure 5:
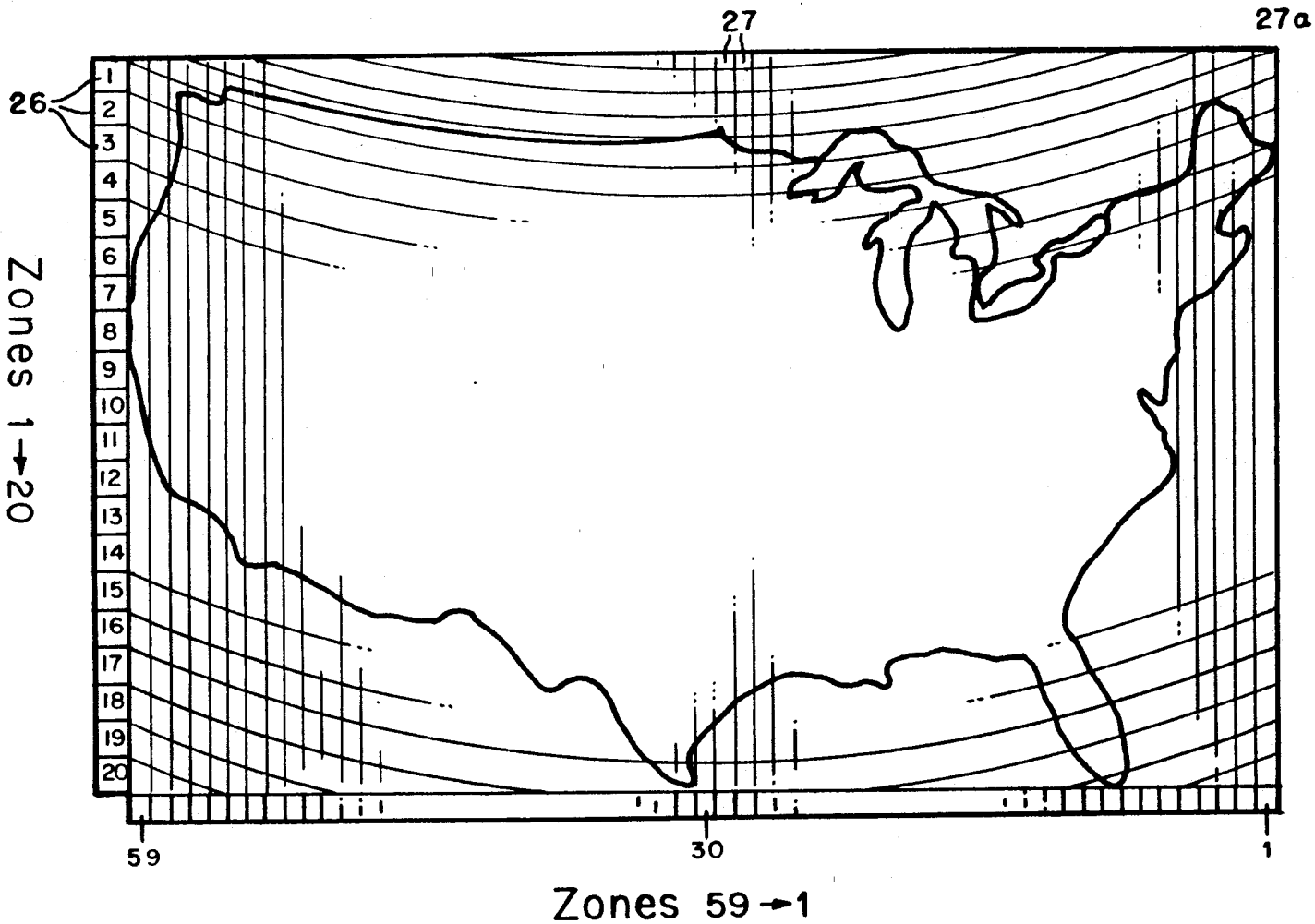
FIG. 5 is a depiction of the continental United States, whereupon a grid is imposed representing particular zones of certain longitudinal dimension and zones of certain latitudinal dimension defining geographic zones in which particular sign boards may be located.

Because the time of sunset and sunrise vary with respect to both longitudinal and latitudinal geographic position, to accurately perform the lighting protocols required action at local sunset and local sunrise it is necessary to establish the geographic location of each sign board 10. Referring to FIG. 5, the continental United States may be divided into a number of zones of a certain latitudinal dimension 26 and a number of zones of a certain longitudinal dimension 27. Although many different numbers of zones may be utilized, the present invention utilizes twenty zones of latitudinal dimension 26 and fifty nine zones of longitudinal dimension 27. Each zone of longitudinal dimension 27 is one degree of longitude in dimension. In which of each particular latitudinal and longitudinal zone 26 and 27 a particular sign board 10 is located is remotely programmed into the memory of control unit 16 by a programming signal directed specifically to that sign board.

Because some of the lighting protocols refer to a particular time of day, as opposed to sunrise or sunset, it is also necessary to program into the memory of control unit 16 by a programming signal the time zone in which the sign board 10 is located.

Timing and event reference signals are broadcast at predetermined times to the common cap address so that they are received and decoded by all control units 16 to establish daily "benchmark" times. Such "benchmark" times may include, for example, sunset and sunrise event signals representing, for example, sunset and sunrise at the intersection of the eastern-most longitudinal zone 27*a* and each of the latitudinal zones 26, as well as 10:00 p.m., 12:00 a.m., 2:00 a.m. and 5:00 a.m. time signals representing, for example, local time in the eastern time zone in the continental United States. Since the geographic location of each sign board 10 is programmed into the memory of its respective control unit 16, control unit 16 can in obtaining the local event or time, reference the "benchmark" time or event and calculate a delay therefrom based upon its particular geographic location or time zone. It will be appreciated that in accordance with the invention, various other "benchmark" times or events may be utilized to control the lighting control units.

In operation, computer 21 calculates the times of sunset and sunrise for the geographic zones defined by the intersection of each zone of latitudinal dimension 26 and the eastern-most zone of longitudinal dimension 27*a*. It then causes transmitter 20 to transmit a timing signal at each of these times. The timing signal is coded as to its origin so that each control unit 16 can identify the timing signal that corresponds to the zone of latitudinal dimension 26 in which it is located and reference only that timing signal with respect to performing the lighting protocol.

Computer 21 also signals the transmitter 20 when to transmit other timing signals representing a particular time of day in the eastern time zone. To enhance accuracy, the computer may reference the clock at the National Bureau of Standards on a daily basis.

If the signal is a programming signal, control unit 16 must provide within control circuits 23 a means to store the signal in memory. If the signal is a timing reference signal, control unit 16 must provide, with reference to the lighting protocol or mode of operation for which the unit is programmed, initiation of a timing period after which the lighting system 13, 14 will be activated.

Referring to FIG. 3, to perform the above described functions with respect to each face 11, 12 control unit 16 may functionally comprise an antenna 30, radio receiver 22, register 25 for storing the twenty-digit data signal, a first comparator 31, a second comparator 32, means for storing in memory a discrete sign address 33, and means for storing in memory a universal sign address 34. In addition, also included are a reference signal buffer 35, a lighting protocol memory 36, a reference signal buffer 37, a programming memory 38, a comparator 40, a fixed comparand 41 and logic gates 42–45. A processor 46 operating in association with a clock circuit 47 utilize the signals stored in buffer 35, memory 36, buffer 37 and memory 38 to provide output signals to the power relay circuit 24*a*, 24*b* associated with the sign board lighting system 13.

In operation, receiver 22 is connected to register 25, and upon receipt by receiver 22, the twenty-digit data signal transmitted to receiver 22 is serially transferred into and stored in register 25.

Although various formats are possible, in the embodiment of FIG. 3, the first six digits stored in register 25 are applied to comparators 31 and 32, which simultaneously receive comparands 33 and 34, respectively. Comparator 31 compares the first six digits with the unique sign address 33 of the particular control unit 16. If comparator 31 finds that the first six digits are identical to sign address 33, it enables logic gate 43 to accept a new lighting protocol or operating mode. Each control unit 16 is assigned a unique sign address 33. Although a six digit address is shown, allowing 999,999 sign boards to be uniquely addressed, it will be appreciated that a greater or lesser number of digits may be utilized depending upon the desired capacity of the system.

The first six digits are also compared by comparator 32 with the universal sign address comparand 34, in this case 000000. If comparator 32 finds that the first six digits are identical to the universal sign address 34, it enables logic gates 42 and 44 to load a new reference signal identification in buffers 35 and 37, which enables the control circuit to determine whether to respond for the lighting protocol in effect. The universal sign address 34 is identical for all control units 16 of all sign boards 10 in the system, and thus all control units 16 decode and respond to the timing signals Since, in the present invention, six digits are utilized for the sign address 33 and there is one universal sign address 34, 999,999 different sign boards 10 may be controlled within a single system by the embodiment described herein. Since all control units 16 contain the same universal sign address 34, all control units 16 will decode and respond to the reference signal. Conversely, only one control unit 16 contains the unique sign address 33, and consequently, only one control unit 16 will respond and store in memory a programming signal.

The composition of timing reference signals is illustrated in FIG. 4. As shown, the first six digits of a reference signal constitute the universal sign address 24. The seventh and eighth digits are identical and represent which of the various reference "benchmarks" the timing reference signal represents. Referring to FIG. 3, for example, if the digits are 2's, the control unit 16 would recognize the timing reference signal as the 10:00 p.m. off signal. If the digits are 1's, the control unit 16 would recognize the timing reference signal as the "sunset on" signal.

The ninth and tenth digits represent the individual zone of latitudinal dimension 26 to which the timing reference signal is referenced. Referring again to FIG. 5, the zones of latitude 26 are numbered consecutively from 1 to 20 starting with the northern-most zone. The eleventh and twelfth digits together represent to which zone of longitudinal dimension 27 the timing signal is referenced, numbered east to west from 1 to 59, or alternatively, the time zone to which the timing signal is referenced. Four standard time zones encompass the continental United States, numbered from east to west 61–64. Four more represent "daylight savings" time zones, numbered east to west 71–74.

Thus, a timing reference signal corresponding to sunset or sunrise in the eastern-most zone of longitudinal dimension 27*a* will contain a 01 in the eleventh and twelfth digits and numbers in the ninth and tenth digits corresponding to which latitudinal zone 26 the timing signal is referenced. Upon reception of such a timing reference signal, the control unit 16 will interpret the 01 in the eleventh and twelfth digits as representing the time of sunset or sunrise at the eastern-most longitudinal zone 27*a*. If the ninth and tenth digits correspond to the values for the latitudinal zone 26 in which the sign board 10 is located, the control unit 16 will calculate the necessary delay to compensate for the difference, if any, in the time of sunset or sunrise between its location and the eastern-most zone of longitude 27*a*. If the ninth and tenth digits do not correspond to the values for the latitudinal zone 26 in which the sign board 10 is located, the control unit 16 will ignore the timing reference signal and await a timing reference signal having a like latitudinal zone.

If the twenty-digit signal represents a timing reference signal transmitted at sunset or sunrise, then control circuit 23, with reference to the transmitted geographic data, and its stored geographic position, utilizes the clock 47 to calculate an appropriate delay, in this case an integral multiple of four minutes for each zone of longitude 27 west of the eastern-most zone of longitude 27*a* in which the sign board 10 is located. To calculate this delay, the control unit 16 could simply subtract the 01 contained in the eleventh and twelfth digits of the timing reference signal from the number representing the longitudinal zone 27 in which the sign board 10 is located and multiply the result by four to get the appropriate delay in minutes.

If the twenty-digit signal represents a timing reference signal transmitted at a particular time of day, the control circuit with reference to the time zone data, utilizes clock 47 to calculate an appropriate delay, which would be an integral multiple of one hour, based upon the number of time zones sign board 10 is located in west of the eastern-most time zone.

The composition of a programming reference signal is as follows. As previously shown, the first six digits represent the unique sign address for the particular control unit 16 to be programmed. Referring again to FIG. 4, the seventh and eighth digits represent the mode of operation in which the control unit 16 is to operate. Thus, to alter the mode of operation for a particular control unit 16, a programming signal is transmitted wherein the first six digits are the unique sign address for the control unit 16, and the seventh and eighth digits are the new lighting protocol or mode of operation for the first and second faces 11, 12. If it is desired to only alter the mode of operation for one of the faces, a dummy variable, "9" may be utilized for the other face so that the mode of operation for that face is not altered.

To program the geographic location and time zone in which the sign board 10 is located, a programming signal is transmitted containing, for example, four "9"'s in the thirteenth through sixteenth digits, the latitudinal zone 26 in which the sign board 10 is located in the seventeenth and eighteenth digits, and the longitudinal zone 27 in which the sign board 10 is located in the nineteenth and twentieth digits. The four "9"'s are recognized by comparator 40, which enables logic gate 45 to convey the new data into memory 38 for utilization by processor 46.

Although this particular embodiment utilizes four "9"'s in the thirteenth through seventeenth digits, it will be appreciated that only one "9" or some other number in a particular digit would be required to signal the control unit 16 that the programming signal contains information pertaining to the geographic location of the sign board 10. In such a case, the other three digits could be utilized to expand the capacity of the system in several ways. For example, the additional digits could be utilized to contain the mode of operation for additional faces on, for example, a four sided sign board. Another possibility is for the other three digits to be utilized to expand the possible lighting protocols for each face. Since the current embodiment utilizes one digit to code the lighting protocol for a particular face, up to ten protocols may be utilized. If two of the other three digits were utilized to code the lighting protocol for each face, up to 100 protocols could be utilized.

Figure 6:
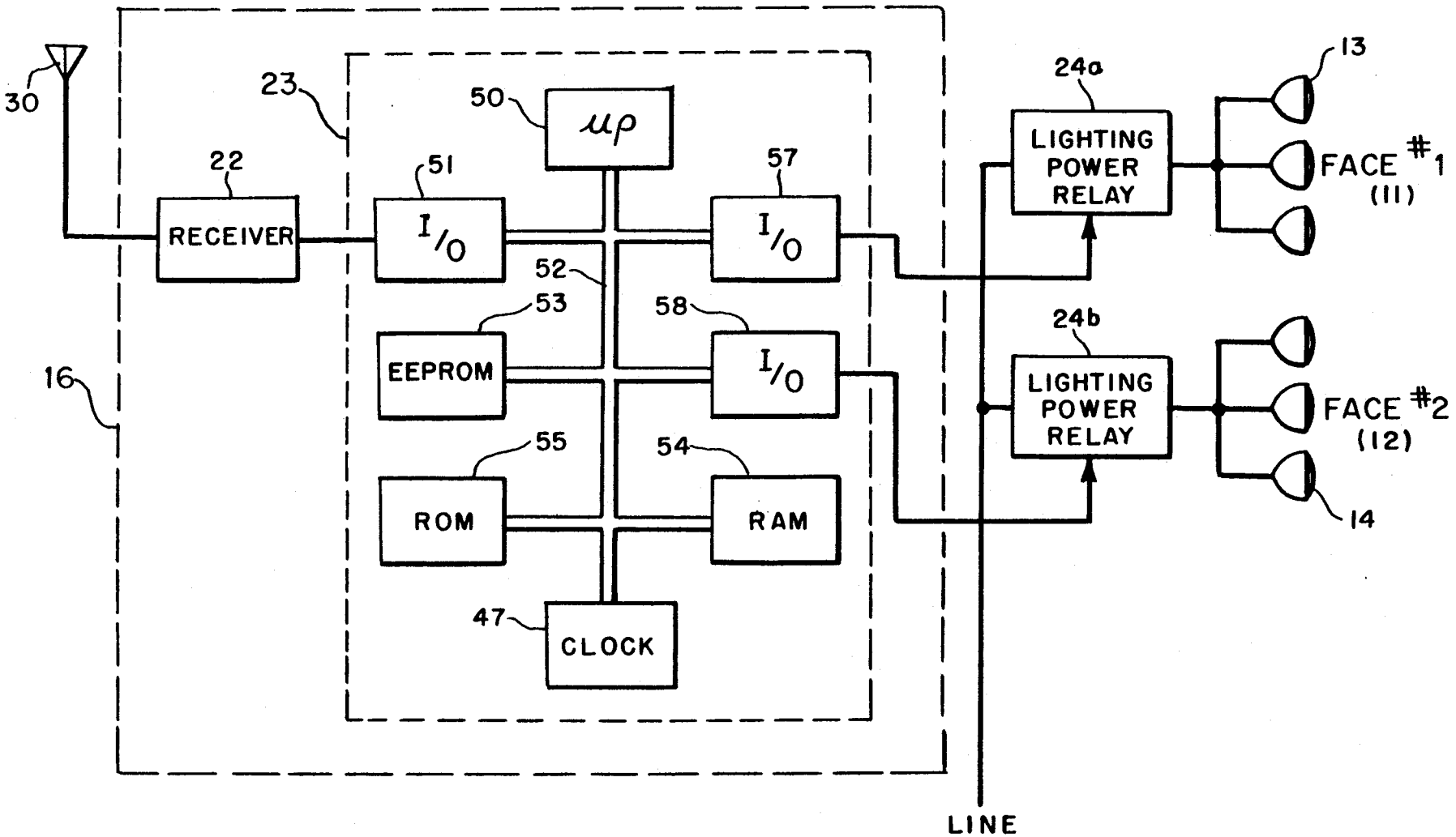
FIG. 6 is a simplified electrical schematic diagram for the lighting system control unit of FIGS. 2.

Referring to FIG. 6, control circuits 23 may be implemented utilizing a microprocessor 50, which may be conventional in design and construction. In the embodiment, radio receiver 22 is connected through an input-/output ("I/O") means 51 to a data bus 52, which connects to an electronic erasable programmable read only memory ("EEPROM") device 53, a random access memory ("RAM") device 54, a read only memory ("ROM") device 55, the clock circuit 47 (which may be integral to microprocessor 50),and two (I/0) circuits 57 and 58 connecting the data bus 52 to two input-output power relay circuits 24*a* and 24*b* associated with sign board faces 11 and 12, respectively. These circuits act as switch circuits to control the application of electric power to lighting systems 13 and 14.

Upon receipt of a signal, the radio receiver serially transmits the twenty-digit reference signal to RAM 54 and microprocessor 50 via I/O circuit 51 and data bus 52. Microprocessor 50 then signals the EEPROM 53 to transfer to it the sign address 33 for that particular control unit 16. The sign address 33 is programmed into the EEPROM during the manufacture of the control unit 16. The microprocessor unit 50 then also signals EEPROM 53, or alternatively ROM 55, to transfer to it the universal sign address 34. The microprocessor 50 then compares the first six digits of the twenty-digit data stream from the receiver to the sign address 33 and the universal sign address 34 to determine whether the received signal represents a programming signal or a timing reference signal.

If the control unit 16 receives a programming signal, the microprocessor 50 transfers the seventh and eighth digits to EEPROM device 53 (or alternatively the RAM device 54) via data bus 52 for storage in memory. Similarly, upon receipt of a programming signal containing "9999" in the thirteenth through sixteenth digits, microprocessor 50 transfers the seventeenth through twentieth digits to EEPROM 53 via data bus 52 for storage in memory.

Referring also to FIG. 4, the "sunrise on" and "sunrise off" modes of operation are not programmable. Each is permanently stored in memory, either in ROM 55 or the EEPROM 53. Thus, unless individually programmed in the locked mode, every control unit 16 operates to enable the switch circuits 24*a* and 24*b* to connect the lighting systems 13 and 14 to the AC line after an appropriate delay upon receipt of a timing reference signal at sunset. Similarly, each control unit 16, unless programmed for an early off mode, will deactivate switch circuits 24*a* and 24*b*, after an appropriate delay, upon receipt of a timing reference signal at sunrise.

If control unit 16 receives timing reference signal, then the seventh and eighth digits are transferred via I/O device 51 and the data bus 52 to microprocessor 50. The microprocessor compares the seventh digit and the eighth digit with the values for the digits stored in EEPROM 53 (or alternatively, RAM 54). If either or both of the seventh digit or eighth digit correspond to the values stored in memory, the microprocessor 50 references the geographical data stored in the EEPROM 53 (or alternatively, RAM 54) and calculates the appropriate delay. With reference to the clock 47, the microprocessor, after the appropriate delay, signals the relay circuits 24*a* and 24*b*, via data bus and I/O circuit 58, to energize lighting systems 13, 14.

In a successful embodiment of control unit 16, microprocessor 50, I/O devices 51, 57 and 58, RAM 54, ROM 55, EEPROM 53 and data bus 52 may be contained on a single or multiple CMOS integrated circuit. This provides increased reliability by obviating the need for discreet circuitry for the included circuit stages.

Figure 7:
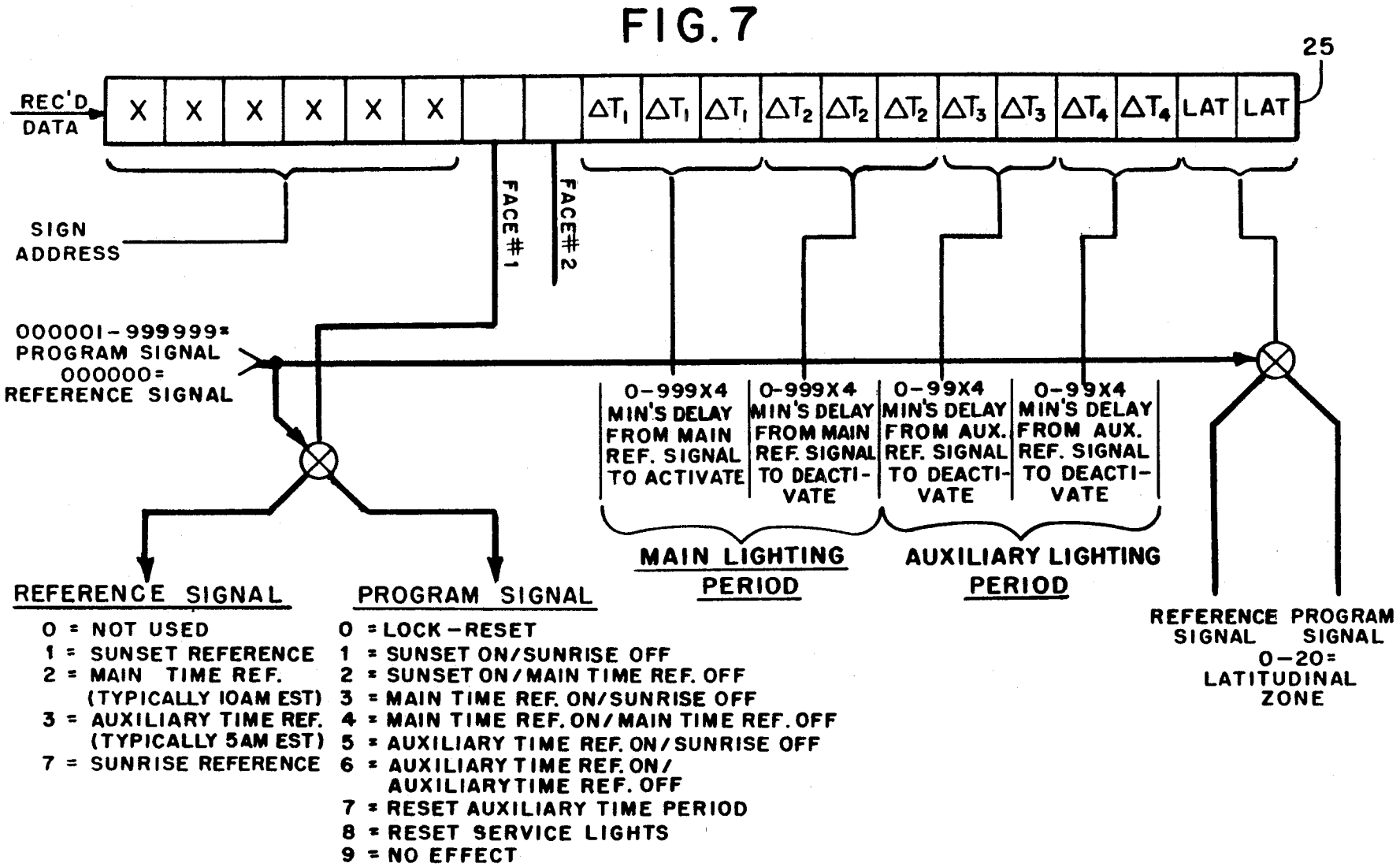
FIG. 7 is a diagram depicting the function of each digit in an exemplary twenty-digit code segment utilized in an alternative embodiment of the invention.

It will be appreciated that other forms of programming signals can be supplied to the lighting control units to achieve the same result. For example, as shown in FIG. 7, each lighting unit could be supplied, as part of the programming signal, with a number calculated by the central computer 21 representing the number of minutes delay required between sunset at the reference location, as before the eastern-most longitudinal zone 27*a*. Sunrise and sunset functions could then be simply conducted by timing from the corresponding one of the twenty latitudinal zone time signals.

Moreover, lighting protocols based on local time could be accomplished by instituting a delay period from, for example, a single 10:00 p.m. EST time signal, representing the earliest possible turn-off under any mode. The time delay required would be calculated by the central computer and conveyed to each lighting control unit as part of the twenty digit programming signal in the form of a number representing the number of minutes in the delay period.

In this way, all calculations would be carried out at the central computer and microprocessor 50 would be required only to recognize the various programming and timing reference signals and initiate preset timing period from a timing reference signal as instructed.

Referring to FIG. 7, as before, the first six digits represent either the universal sign address if the signal is a timing reference signal or the unique sign address 33 if the signal is a programming signal. The seventh and eighth digits represent the mode of operation for each of the two faces 11 and 12 of the sign board. The ninth, tenth and eleventh digits represent the delay from the time the reference signal, which could either be an "event signal" representing sunset or sunrise or of "time signal" corresponding to a timing reference signal which the control unit 16 is to reference when activating the lighting system 13 or 14 is received to when the lighting system 13 or 14 should be activated. The twelfth, thirteenth and fourteenth digits represent the minutes delay from the time the reference signal which the control unit is to reference when activating the lighting system 13 or 14 is received to when the lighting system 13 or 14 should be activated. The next four digits allow for an auxiliary timing period so that the unit may turn on and off more than one time per day.

While particular embodiments of the invention have been shown and described, it will be obvious to those skilled in the art that changes and modifications may be made therein without departing from the invention in its broader aspects, and, therefore, the aim of the appended claims is to cover all such changes and modifications as fall within the true spirit and scope of the invention.

For example, while the particular embodiments of the invention described above has described a twenty-digit programming or reference code, each digit of which represents particularly described data, it will be obvious to those skilled in the art that changes and modifications may be made with respect to the length of the transmitted code, the particular data represented by each digit and the order of the digits therein without departing from the invention in its broader aspects, and, therefore, the aim of the appended claims is to cover all such changes and modifications as fall within the true spirit and scope of the invention.

I claim:

1. A system for controlling the illumination of each one of a plurality of sign boards in accordance with predetermined lighting protocols, assigned to each sign board, each protocol requiring predetermined on and off times, comprising:

transmission means for transmitting at least one reference signal; a lighting control unit associated with each, sign board, each said lighting control unit including receiver means for receiving each said transmitted reference signal, timing means responsive to each said received reference signal for initiating a predetermined timing period and sign lighting circuit means responsive to said timing means for controlling the application of operating current to the illuminating means of each said sign board following said timing period, whereby each said sign board is illuminated in accordance with its respective lighting protocol.

2. A system for controlling the illumination of a plurality of sign boards as defined in claim 1 wherein the sign boards are disposed in diverse geographic locations and wherein said timing period is dependent upon the geographic location of said sign board.

3. A system for controlling the illumination of a plurality of sign boards as defined in claim 1 wherein said transmission means and said receiver means comprise conventional paging or beeper systems.

4. A system for controlling the illumination of a plurality of sign boards as defined in claim 1, wherein at least one of said reference signals is transmitted by said transmission means at a predetermined time corresponding to sunset or sunrise at a predetermined geographic location.

5. A system for controlling the illumination of a plurality of sign boards as defined in claim 4, wherein said predetermined geographic location is disposed approximately along the east coast of the continental Unites States.

6. A system for controlling the illumination of a plurality of sign boards as defined in claim 1, wherein said transmission means further includes means for transmitting at least one lighting protocol programming signal to each said sign board, said sign board control unit further includes means for receiving each said programming signal and said timing period is dependent upon said received programming signal.

7. A system for controlling the illumination of a plurality of sign boards as defined in claim 6, wherein each said programming signal includes an address unique to one of said sign boards.

8. A system for controlling the illumination of a plurality of sign boards as defined in claim 1 wherein at least one of said transmitted reference signals is transmitted by said transmission means at a predetermined local time at a predetermined geographic location.

9. A system for controlling the illumination of a plurality of sign boards as defined in claim 8, wherein said predetermined geographic location is located in the eastern time zone of the continental United States.

10. A system for controlling the illumination of a plurality of sign boards as defined in claim 1, wherein data identifying the geographic location of each said sign board is stored in a computer memory device.

11. A system for controlling the illumination of a plurality of sign boards as defined in claim 1, wherein said timing means comprises a microprocessor device.

12. A system for controlling the illumination of a plurality of sign boards as defined in claim 1, wherein at least one of said sign boards includes a plurality of faces and wherein the illumination of at least one of said faces is independently controlled.

13. A system for controlling the illumination of a plurality of sign boards equipped with a lighting system in accordance with a predetermined lighting protocol assigned to each sign board requiring predetermined on and off times, comprising: transmission means for transmitting at least one reference signal and at least one programming signal, a lighting control unit associated with each sign board, each said lighting control unit including receiver means for receiving said transmitted reference signals and said transmitted programming signals, timing means responsive to a received reference signal for initiating a predetermined timing period, said predetermined timing period being determined by a said received programming signal and sign lighting control circuit means responsive to said timing means for controlling the application of operating current to the lighting system of said sign board following said timing period, whereby each said sign board is caused to be illuminated in accordance with its respective predetermined lighting protocol.

14. A system for controlling the illumination of a plurality of sign boards as defined in claim 13 wherein the sign boards are disposed in diverse geographic locations and wherein said timing period is dependent upon the geographic location of said sign board.

15. A system for controlling the illumination of a plurality of sign boards as defined in claim 13, wherein said transmission means and said receiver means comprise conventional paging or beeper systems.

16. A system for controlling the illumination of a plurality of sign boards as defined in claim 13 wherein at least one of said reference signals is transmitted by said transmission means at a predetermined time corresponding to sunset or sunrise at a predetermined geographic location.

17. A system for controlling the illumination of a plurality of sign boards as defined in claim 16, wherein said predetermined geographic location is disposed approximately along the east coast of the continental United States.

18. A system for controlling the illumination of a plurality of sign boards as defined in claim 13, wherein each said programming signal includes an address unique to at least one signal board.

19. A system for controlling the illumination of a plurality of sign boards as defined in claim 13 wherein at least one of said transmitted reference signals is transmitted by said transmission means at a predetermined local time at a predetermined geographic location.

20. A system for controlling the illumination of a plurality of sign boards as defined in claim 19, wherein said predetermined geographic location is in the eastern time zone of the continental United States.

21. A system for controlling the illumination of a plurality of sign boards as defined in claim 14, wherein data identifying the geographic location of each said sign board is stored in a computer memory device.

22. A system for controlling the illumination of a plurality of sign boards as defined in claim 13, wherein said timing means comprises a microprocessor device.

23. A system for controlling the illumination of a plurality of sign boards as defined in claim 13, wherein at least one of said sign boards comprises a plurality of faces and wherein the illumination of at least one of said faces is independently controlled.

24. A lighting control device operable from a received reference signal for controlling the illumination of a sign board in accordance with a predetermined lighting protocol requiring predetermined on and off times, comprising: radio receiver means for receiving at least one reference signal, timing means responsive to a received reference signal for initiating a predetermined timing period and sign lighting control circuit means responsive to said timing means for controlling the application of operating current to a lighting means of said sign board following said timing period, whereby said sign board is caused to be illuminated in accordance with its lighting protocol, said reference signal controlling a plurality of sign boards.

25. A lighting control device for controlling the illumination of a sign board as defined in claim 24 wherein the sign board is one of a plurality of sign boards disposed in diverse geographic locations and wherein said timing period is dependent upon the geographic location of said sign board.

26. A lighting control device for controlling the illumination of a sign boards as defined in claim 25, wherein said receiver means comprises a conventional paging or beeper receiving apparatus.

27. A lighting control device for controlling the illumination of a sign board as defined in claim 24 wherein at least one of said reference signals is transmitted at a predetermined time corresponding to sunset or sunrise at a predetermined geographic location.

28. A lighting control device for controlling the illumination of a sign board as defined in claim 27, wherein said predetermined geographic location is disposed approximately along the east coast of the Continental United States.

29. A lighting control device for controlling the illumination of a sign board as defined in claim 24, wherein each said reference signal includes a lighting protocol programming signal portion, said control device further including means for receiving said programming signal portion, and said timing portion is dependent upon said programming signal portion of each said received reference signal.

30. A lighting control device for controlling the illumination of a sign board as defined in claim 29, wherein said programming signal portion includes an address unique to at least one sign board.

31. A lighting control device for controlling the illumination of a sign board as defined in claim 24 wherein said reference signal is transmitted at a predetermined local time at a predetermined location.

32. A lighting control device for controlling the illumination of a sign board as defined in claim 31 wherein said predetermined location is in the eastern time zone of the continental United States.

33. A lighting control device for controlling the illumination of a sign board as defined in claim 25, wherein data identifying each of said geographic locations are stored in a computer memory device.

34. A lighting control device for controlling the illumination of a sign board as defined in claim 24, wherein said sign board comprises a plurality of faces and wherein the illumination of at least one of said faces is independently controlled by a said received reference signal.

35. A lighting control device operable upon receiving at least one transmitted reference signal and at least one transmitted programming signal to control the illumination of a sign board in accordance with a predetermined lighting protocol assigned to said sign board requiring predetermined on an off times, comprising: radio receiver means for receiving said transmitted reference and programming signals, timing means responsive to a said received reference signal for initiating a predetermined timing period, said predetermined timing period determined by a said transmittted and received programming signal, and sign lighting control circuit means responsive to said timing means for controlling the application of operating current to lighting means on each said sign board following said timing period; whereby each said sign board is illuminated in accordance with its respective lighting protocol, said reference signal controlling a plurality of sign boards.

36. A lighting control device for controlling the illumination of a sign board as defined in claim 35 wherein the sign board is one of a plurality of sign boards disposed in diverse geographic locations and wherein said timing period is dependent upon the geographic location of said sign board.

37. A lighting control device for controlling the illumination of a sign board as defined in claim 35, wherein said radio receiver means comprises a conventional paging or beeper receiving apparatus.

38. A lighting control device for controlling the illumination of a sign board as defined in claim 35 wherein at least one of said reference signal is transmitted at a predetermined time corresponding to sunset or sunrise at a predetermined geographic location.

39. A lighting control device for controlling the illumination of a sign board as defined in claim 38, wherein said predetermined geographic location is disposed approximately along the east coast of the Continental United States.

40. A lighting control device for controlling the illumination of a sign board as defined in claim 38, wherein said programming signal includes an address unique to at least one of said sign boards.

41. A lighting control device for controlling the illumination of a sign board as defined in claim 35, wherein a said reference signal is transmitted at a predetermined local time at a predetermined location.

42. A lighting control device for controlling the illumination of a sign board as defined in claim 41 wherein said predetermined location is in the eastern time zone of the continental United States.

43. A lighting control device for controlling the illumination of a sign board as defined in claim 36, wherein data identifying each of said geographic locations are stored in a computer memory device.

44. A lighting control device for controlling the illumination of a sign board as defined in claim 35, wherein said sign board comprises a plurality of faces and wherein the illumination of at least one of said faces is independently controlled by received reference and programming signals.

45. A method for controlling the illumination of a selected one of a plurality of sign boards having a lighting means in accordance with a predetermined lighting protocol assigned to said selected sign board requiring predetermined on and off times, comprising: transmitting at least one reference signal to said plurality of sign boards, receiving a transmitted reference signal at at least one selected sign board, initiating a timing period at each said selected sign board in response to the received reference signal and controlling the application of operating current to the lighting means of each said selected sign board following its timing period, whereby each said selected sign board is caused to be illuminated in accordance with its predetermined lighting protocol.

46. The method for controlling the illumination of a sign board as defined in claim 45 wherein the sign boards are dispersed in diverse geographic locations, comprising the additional step of setting the timing period according to the geographic location of the sign board.

47. The method for controlling the illumination of a sign board as defined in claim 45 wherein the transmitted reference is received by a receiver means of a conventional paging or beeper system.

48. The method for controlling the illumination of a sign board as defined in claim 45 comprising the additional step of transmitting a reference signal at predetermined times corresponding to sunrise and sunset at predetermined geographic locations.

49. The method for controlling the illumination of a sign board as defined in claim 45 comprising the additional step of transmitting a programming signal to a said selected sign board, receiving the programming signal at a said selectee sign board and setting the timing period of said selectee sign board according to the received programming signal.

50. The method for controlling the illumination of a sign board as defined in claim 49 wherein the programming signal includes an address portion unique to the selected sign board.

51. The method for controlling the illumination of a sign board as defined in claim 45 wherein at least one of the transmitted reference signals is transmitted at a predetermined local time at a predetermined location.

52. The method for controlling the illumination of a sign board as defined in claim 51 wherein said predetermined location is in the eastern time zone of the continental United States.

53. The method for controlling the illumination of a sign board a defined in claim 48 wherein said predetermined geographic locations are disposed approximately along the east coast of the continental United States.

54. The method for controlling the illumination of a sign board as defined in claim 45 further including the step of storing data identifying the geographic location of each sign board in a computer memory device.

55. The method for controlling the illumination of a sign board as defined in claim 45 wherein the timing period is initiated in a computer microprocessor device.

56. A method for controlling the illumination of a sign board as defined in claim 45 wherein a said selected sign board includes a plurality of faces and said method is effective to independently control illumination of at least one of said faces.

57. A method for controlling the illumination of a selected one of a plurality of sign boards in accordance with a predetermined lighting protocol assigned to said sign board requiring predetermined on and off times, comprising: transmitting at least one reference signal to each of said sign boards, transmitting at least one programming signal to each said selected sign board; receiving at least one transmitted reference signal and at least one said programming signal at each said selected sign board; initiating a timing period at each said selected sign board in response to a received reference signal, said timing period being determined by a said received programming signal; and controlling the application of operating current to lighting means on each selected sign board following the timing period; whereby each selected sign board is caused to be illuminated in accordance with its respective predetermined lighting protocol.

58. The method for controlling the illumination of a sign board as defined in claim 57, wherein the sign boards are dispersed in diverse geographic locations and further comprising the additional step of setting the timing period according to the geographic location of the sign board.

59. The method for controlling the illumination of a sign board as defined in claim 57, wherein the receiving step is performed by receiver means in a conventional paging or beeper system.

60. The method for controlling the illumination of a sign board as defined in claim 57, further comprising the step of transmitting reference signals at predetermined times corresponding to sunrise and sunset at predetermined geographic locations.

61. The method for controlling the illumination of a sign board as defined in claim 57, wherein the programming signal includes an address unique to each said selected sign board.

62. The method for controlling the illumination of a sign board as defined in claim 57 wherein at least one of the transmitted reference signals is transmitted at a predetermined local time at a predetermined location.

63. The method for controlling the illumination of a sign board as defined in claim 62 wherein said predetermined location is in the eastern time zone of the continental United States.

64. The method for controlling the illumination of a sign board as defined in claim 60 wherein said predetermined geographic locations are disposed approximately along the east coast of the continental United States.

65. The method for controlling the illumination of a sign board as defined in claim 58, wherein data identifying the geographic locations of the sign boards are stored in a computer memory device.

66. The method for controlling the illumination of a sign board as defined in claim 57, wherein the timing period is initiated by a computer microprocessor device.

67. A method for controlling the illumination of a sign board as defined in claim 57, wherein said selected sign board comprises a plurality of faces and wherein said method is effective to independently control at least one of said faces.

68. A system for controlling the illumination of illumination means on each one of a plurality of sign boards disposed in diverse geographic locations in accordance with predetermined lighting protocols, each protocol requiring predetermined on and off times, comprising: transmission means for transmitting at least one reference signal, a lighting control unit associated with each sign board, each said lighting control unit including receiver means for receiving each transmitted reference signal, timing means responsive to each received reference signal for initiating a predetermined timing period depending upon the geographic location of the sign board and sign lighting circuit means responsive to said timing means for controlling the application of operating current to the illuminating means of each said sign board following said timing period, whereby each said sign board is illuminated in accordance with its respective lighting protocol.

69. A system for controlling the illumination of a plurality of sign boards having lighting means in accordance with predetermined lighting protocols assigned to each sign board, each protocol requiring predetermined on and off times, comprising: transmission means for transmitting at least one reference signal and at least one programming signal, a lighting control unit associated with each sign board, each said lighting control unit including receiver means for receiving said transmitted reference signals and said transmitted programming signals, timing means responsive to a received reference signal for initiating a predetermined timing period, said predetermined timing period being determined by a received programming signal and being dependent upon the geographic location of the sign board, and sign lighting control circuit means responsive to said timing means for controlling the application of operating current to the lighting means of said sign board following said timing period, whereby each said sign board is caused to be illuminated in accordance with its respective predetermined lighting protocol.

70. A lighting control device operable from a received reference signal for controlling the illumination of a sign board having a lighting means in accordance with a predetermined lighting protocol requiring predetermined on and off times, said sign board being one of a plurality of sign boards disposed in diverse geographic locations, said device comprising: radio receiver means for receiving at least one said reference signal, timing means responsive to a received reference signal for initiating a predetermined timing period dependent upon the geographic location of said sign board and sign lighting control circuit means responsive to said timing means for controlling the application of operating current to the lighting means of said sign board following said timing period, whereby said sign board is caused to be illuminated in accordance with its predetermined lighting protocol.

71. A method for controlling the illumination of a selected one of a plurality of sign boards having lighting means and being disposed in diverse geographical locations in accordance with a predetermined lighting protocol assigned to said selected sign board, said lighting protocol requiring predetermined on and off times, comprising: transmitting at least one reference signal to said plurality of sign boards, receiving a transmitted reference signal at least one selected sign board, initiating a timing period at a said selected sign board in response to the received reference signal which timing period is dependent upon the geographic location of said selected sign board, and controlling the application of operating current to the lighting means of a said sign board following the timing period, whereby each said selected sign board is caused to be illuminated in accordance with its predetermined lighting protocol.

* * * * *